US008421790B2

(12) United States Patent
Wang

(10) Patent No.: US 8,421,790 B2
(45) Date of Patent: Apr. 16, 2013

(54) INTEGRATED CIRCUIT FOR SRAM STANDBY POWER REDUCTION IN LCD DRIVER

(75) Inventor: Szu-Mien Wang, Tai-Pei (TW)

(73) Assignee: Orise Technology Co., Ltd., Hsinchu (TW)

( * ) Notice: Subject to any disclaimer, the term of this patent is extended or adjusted under 35 U.S.C. 154(b) by 115 days.

(21) Appl. No.: 13/230,011

(22) Filed: Sep. 12, 2011

(65) Prior Publication Data

US 2012/0062541 A1 Mar. 15, 2012

(30) Foreign Application Priority Data

Sep. 14, 2010 (TW) ..... 99130967 A

(51) Int. Cl.
*G09G 5/00* (2006.01)

(52) U.S. Cl.
USPC ..... 345/211

(58) Field of Classification Search ..... 345/211, 345/87, 204, 213, 98, 530; 365/200, 189.05; 711/104, 169
See application file for complete search history.

(56) References Cited

U.S. PATENT DOCUMENTS

| | | | | |
|---|---|---|---|---|
| 6,094,703 | A * | 7/2000 | Pawlowski | 711/104 |
| 6,205,514 | B1 * | 3/2001 | Pawlowski | 711/104 |
| 6,253,298 | B1 * | 6/2001 | Pawlowski | 711/169 |
| 6,771,247 | B2 * | 8/2004 | Sato et al. | 345/98 |
| 6,873,320 | B2 * | 3/2005 | Nakamura | 345/204 |
| 6,882,583 | B2 * | 4/2005 | Gorman et al. | 365/200 |
| 6,965,365 | B2 * | 11/2005 | Nakamura | 345/87 |
| 7,209,131 | B2 * | 4/2007 | Matsumoto | 345/211 |
| 7,813,189 | B2 * | 10/2010 | Chan et al. | 365/189.05 |
| 2002/0167510 | A1 * | 11/2002 | Matsumoto | 345/211 |
| 2004/0184328 | A1 * | 9/2004 | Kobayashi et al. | 365/200 |
| 2008/0122830 | A1 * | 5/2008 | Kotani et al. | 345/213 |
| 2009/0091579 | A1 * | 4/2009 | Teranishi et al. | 345/530 |

* cited by examiner

*Primary Examiner* — Fred Tzeng
(74) *Attorney, Agent, or Firm* — Muncy, Geissler, Olds & Lowe, PLLC

(57) ABSTRACT

The present invention relates to an integrated circuit (IC) for SRAM (Static Random Access Memory) standby power reduction in LCD (Liquid Crystal Display) driver. The IC layout mainly disposes a high-current endurable transistor between a power supply pad and a power supply metal layer of the SRAM matrix. When the IC enters a standby mode, the electrical interconnection between the power supply pad and the power supply metal layer of the SRAM is cut off through the transistor so that the leakage current and the power consumption of the SRAM can be reduced.

12 Claims, 7 Drawing Sheets

INTEGRATED CIRCUIT FOR SRAM STANDBY POWER REDUCTION IN LCD DRIVER

This application claims priority of No. 099130967 filed in Taiwan R.O.C. on Sep. 14, 2010 under 35 USC 119, the entire content of which is hereby incorporated by reference.

BACKGROUND OF THE INVENTION

1. Field of Invention

The invention relates to the technology associated with a layout of a driver of liquid crystal display (LCD), and more particularly to an integrated circuit for static random access memory (SRAM) standby power reduction in LCD driver.

2. Related Art

FIG. 1 is a system block diagram of the liquid crystal display (LCD) according to the prior art. Referring to FIG. 1, the LCD includes a display panel 101, a source driver 102, a gate driver 103 and a timing controller 104, wherein the timing controller 104 includes an embedded frame buffer 105. General speaking, since the driver of the LCD with the high resolution has a embedded frame buffer 105 and the stored data of the frame buffer 105 should be maintained in the wait state or the idle state, the large power consumption thereof is generated, where the main reason to generate the power consumption is to refresh frame so as to frequently access the embedded frame buffer 105 of the driver of the LCD.

In order to reduce the power consumption of the display panel, a memory in pixel (MIP) technology is provided. This technology can achieve the very lower power consumption when the frame does not change or the partial frame change. Further, the MIP technology is used for storing a partial data, such as most significant bit (MSB), into the pixel or sub-pixel. The MIP technology can be used for replacing one bit or three bits of each pixel data, wherein each pixel data generally includes 24 bits (each R, G, B data respectively includes 8 bits data). As above, the color representation of the LCD can be still maintained and the LCD system does not need to frequently access the frame buffer 105. Thus, the dynamic power consumption can be reduced.

For example, in the power saving mode, such as the wait state or the idle state, the LCD only need the MSB of each R, G, B pixel data. In addition, it is assumed that the LCD only displays a timepiece in the wait state. Originally the frame buffer 105 should be accessed 60 times per second. Since the MIP technology is provided, and the second hand of the timepiece moves once per second, the frame buffer 105 can be accessed once per second to refresh the memory unit of the MIP.

The abovementioned technology can effectively reduce the accessed time of the frame buffer 105. However, in the wait state, only the MSB is accessed, the remained seven least significant bits (LSB) does not be accessed. When the seven LSBs stored in the frame buffer 105 does not be accessed, the frame buffer 105, the leakage current of the frame buffer 105 becomes the main issue of the power consumption.

In order to further reduce the power consumption of the LCD system, the present invention provides a new layout of the SRAM circuit.

SUMMARY OF THE INVENTION

An object of the invention is to provide an Integrated Circuit (IC) layout for reducing the power consumption of the SRAM in idle mode in order to reduce the power consumption of the SRAM in LCD system.

To achieve the above-identified or other objects, the invention provides a driving circuit, adapted for a liquid crystal display, wherein the liquid crystal display has memory in pixel. The driving circuit includes a least significant bit (LSB) static random access memory (SRAM) array, a pad, a power transistor and a most significant bit (MSB) static random access memory (SRAM) array. A plurality of word lines and a plurality of bit lines respectively disposed along the first axis direction of the LSB SRAM array and the second axis direction of the LSB SRAM array, wherein along the first axis direction, the LSB SRAM array further comprises a plurality of first common voltage lines, electrically connected to a common voltage, wherein the first common voltage lines and the word lines is interlacedly disposed, wherein, a first N-well pick-up power connecting line and a P-well pick-up power connecting line are disposed when the number of the word lines reach a first amount, wherein the P-well pick-up power connecting line is electrically connected to the common voltage.

Along the second axis direction, the LSB SRAM array further comprises a plurality of bit bar lines, a plurality of first power voltage lines, wherein the bit lines, the first power voltage lines, and the bit bar lines are disposed in turn of the bit line, the first power voltage line, the bit bar line, the bit bar line, the first power voltage line, the bit line along the second axis direction of the LSB SRAM, wherein a second common voltage line is disposed when the number of the bit lines reach a second amount.

Next, the pad is coupled to a power voltage. The power transistor comprises a gate terminal, a first source/drain terminal and a second source/drain terminal, wherein the first source/drain terminal is coupled to the pad, the second source/drain terminal is coupled to the first N-well pick-up power connecting lines and the first power voltage lines. The most significant bit (MSB) static random access memory (SRAM) array comprises a plurality of second N-well pick-up power connecting lines and a plurality of second power voltage lines, wherein the second N-well pick-up power connecting lines and the second power voltage lines are respectively coupled to the power voltage, wherein the MSB SRAM array and the LSB SRAM share the word lines, the first common voltage lines and the P-well pick-up power connecting lines, wherein, the power transistor is cut off the electrical connection between the first source/drain terminal and the second source/drain terminal.

The invention provides another driving circuit, adapted for a liquid crystal display, wherein the liquid crystal display has memory in pixel. The driving circuit comprises a least significant bit (LSB) static random access memory (SRAM) array, a pad, a power transistor and a most significant bit (MSB) static random access memory (SRAM) array. A plurality of word lines and a plurality of bit lines respectively disposed along the first axis direction of the LSB SRAM array and the second axis direction of the LSB SRAM array, wherein a N-well pick-up power connecting line and a P-well pick-up power connecting line are disposed when the number of the word lines reach a first amount, wherein the N-well pick-up power connecting line is electrically connected to a power voltage, and the P-well pick-up power connecting line is electrically connected to a common voltage, and along the second axis direction of the LSB SRAM array, wherein a plurality of bit bar lines, a plurality of first power voltage lines and a plurality of common voltage lines are disposed along the second axis direction of the LSB SRAM array, wherein the common voltage lines are electrically connected to the common voltage, wherein the bit lines, the first power voltage lines, the common voltage lines and the bit bar lines are disposed in turn of the bit line, the first power voltage line, the bit bar line, the common voltage line, the bit bar line, the first power voltage line, the bit line and the common voltage line.

Next, the pad is coupled to the power voltage. The power transistor comprises a gate terminal, a first source/drain terminal and a second source/drain terminal, wherein the first source/drain terminal is coupled to the pad, the gate terminal receiving a standby signal, the second source/drain terminal is coupled to the first N-well pick-up power connecting lines and the first power voltage lines. The most significant bit (MSB) static random access memory (SRAM) array comprises a plurality of second N-well pick-up power connecting lines, wherein the second N-well pick-up power connecting lines are coupled to the power voltage, wherein the MSB SRAM array and the LSB SRAM array share the word lines, the N-well pick-up power connecting lines and the P-well pick-up power connecting lines, wherein the power transistor is cut off the electrical connection between the first source/drain terminal and the second source/drain terminal.

The spirit of the invention is to dispose an extra high-current endurable power transistor between the power supply metal layer of the LSB SRAM array and the pad. When the idle mode is entered, the power transistor electrically disconnects the circuit between the pad and the LSB SRAM array such that the leakage current is avoided and the power consumption thereof is thus reduced.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Before the description of the present invention, in order to conveniently describe the embodiments of the present invention, the SRAM in the forgoing embodiments is built into the LCD driver for access the frame data. Further, the LCD having the technology of memory in pixel (MIP) is also assumed.

Figure 1:
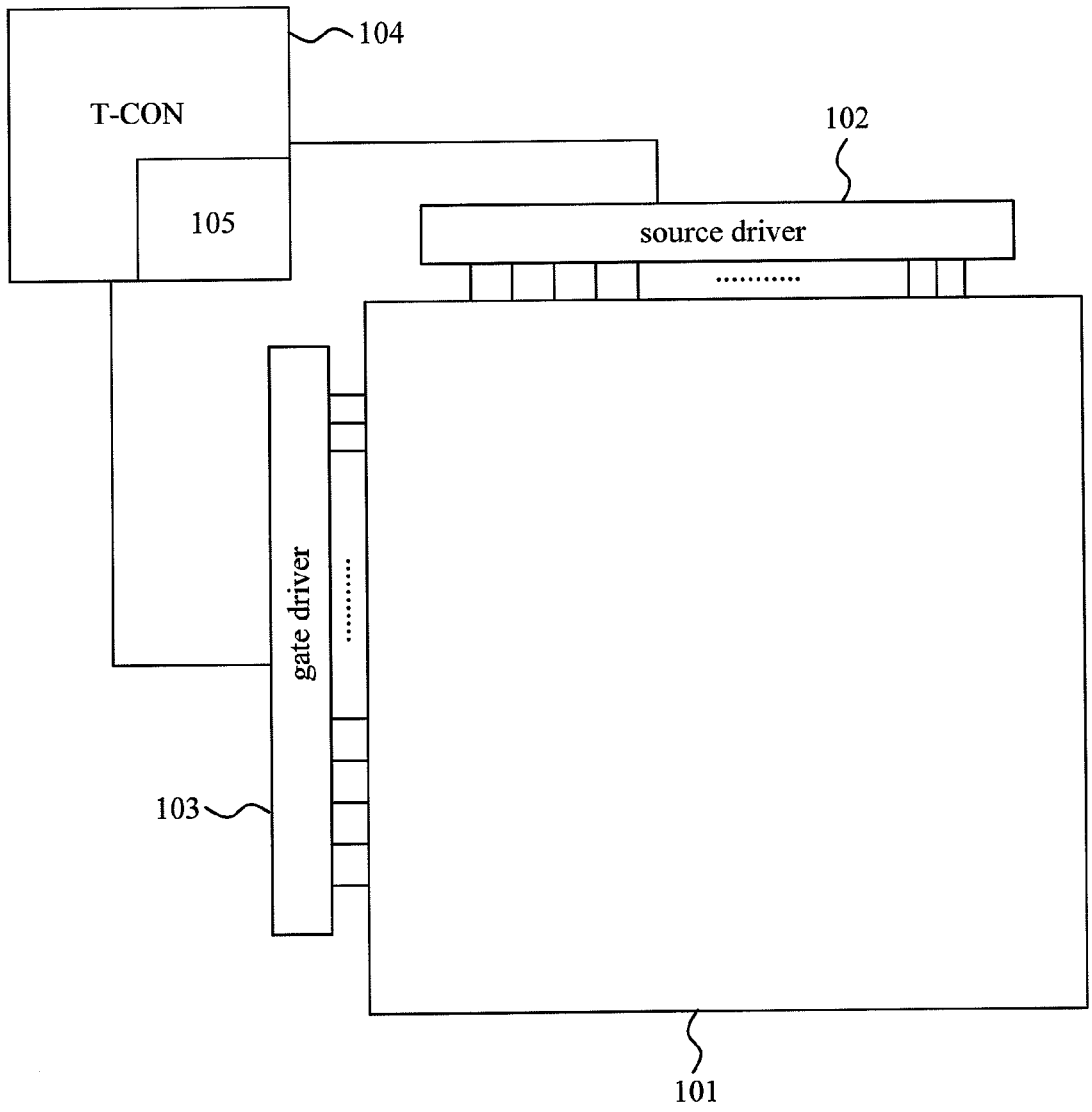
FIG. 1 (prior art)
FIG. 1 is a system block diagram depicting a liquid crystal display according to a conventional art.
Figure 2:
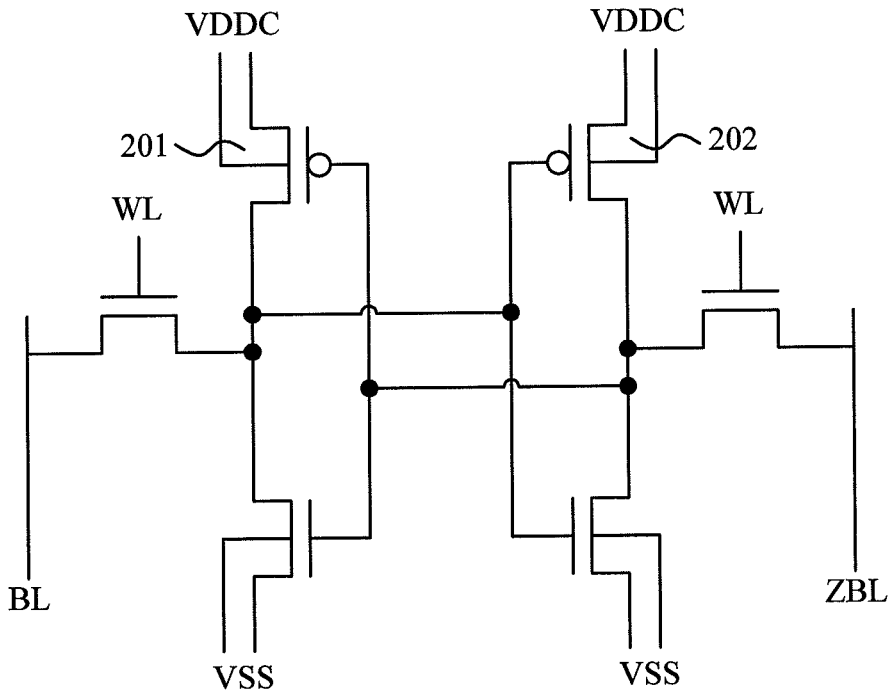
FIG. 2 is a circuit diagram depicting a cell of a SRAM according to the first embodiment of the present invention.

FIG. 2 is a circuit diagram depicting a cell of a SRAM according to the first embodiment of the present invention. Referring to FIG. 2, the SRAM comprises six transistors. Since the operation of the SRAM circuit is a conventional art, the detail description for the circuit operation is omitted. In the present embodiment, the body terminals of the P-type MOSFET 201 and 202 and the source terminal of the P-type MOSFET 201 and 202 are respectively coupled to the power connecting node VDDC.

Figure 3:
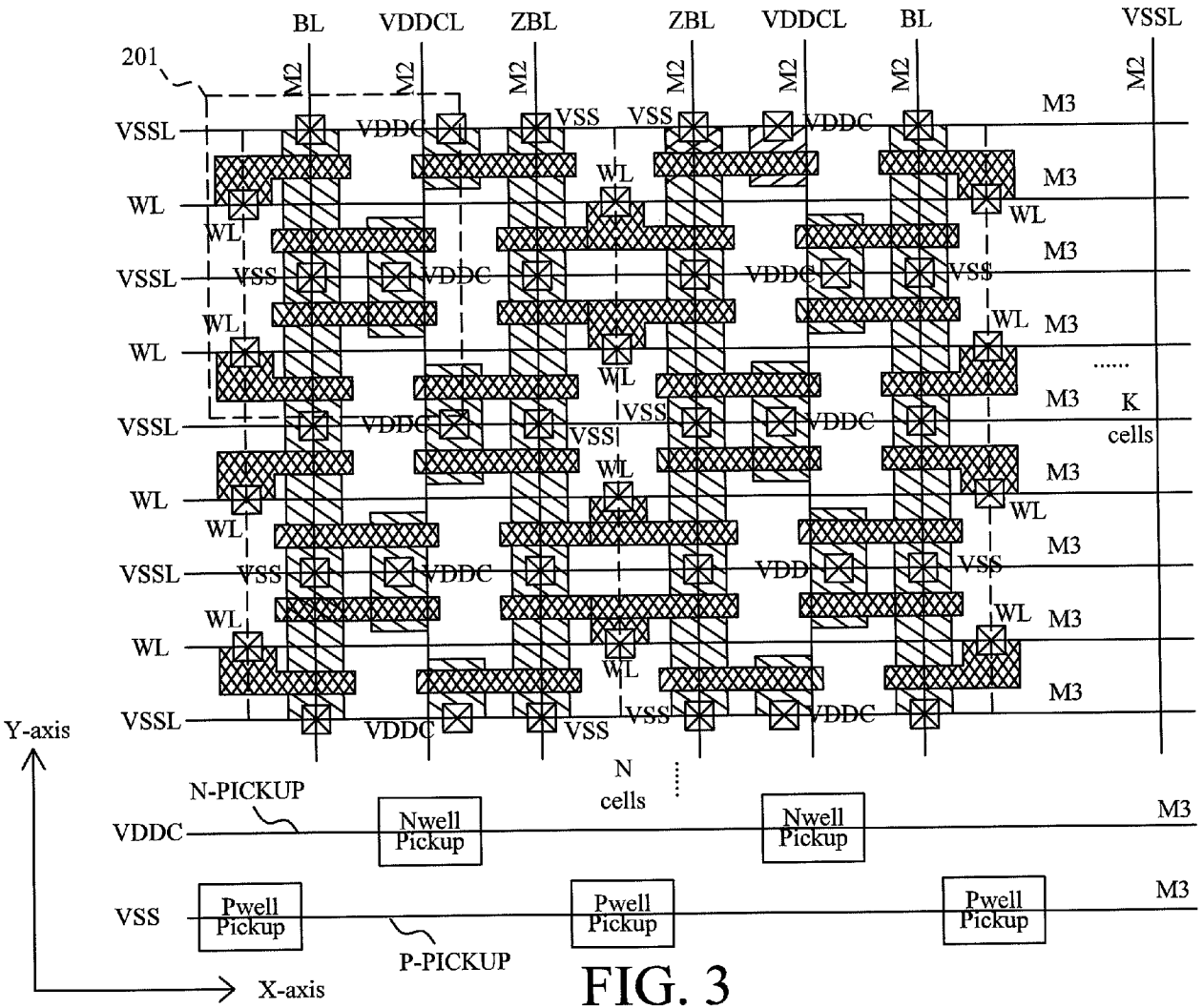
FIG. 3 is a circuit layout depicting a partial top view of the LSB SRAM array according to the first embodiment of the present invention.

FIG. 3 is a circuit layout depicting a partial top view of the LSB SRAM array according to the first embodiment of the present invention. Referring to FIG. 3, in the present embodiment, the SRAM is separated to two parts, that is, the LSB SRAM array and the MSB SRAM array. In FIG. 3, the layout of the LSB SRAM is only illustrated. Since the LCD having the technology of MIP, the refresh rate of the frame is only one time per second when the power saving mode, such as wait state or idle state, is entered. In addition, only the MSB should be refreshed when the power saving mode is entered. In the present embodiment, the layout of the MSB SRAM array and the layout of the LSB SRAM array are separated.

Moreover, along the direction of Y-axis, the common voltage lines VSSL and the word lines WL are interlacedly arranged from the above to the bottom. In order to prevent the body effect, one N-well pick-up power connecting line N-pickup and one P-well pick-up power connecting line P-pickup are disposed between every N cells, wherein the P-well pick-up power connecting line P-pickup is electrically connected to the common voltage VSS, and the N-well pick-up power connecting line N-pickup is electrically connected to the abovementioned power connecting node VDDC. In the present embodiment, the common voltage lines VSSL, the word lines WL, the N-well pick-up power connecting lines N-pickup and the P-well pick-up power connecting lines P-pickup are disposed on the third metal layer M3.

Along the direction of X-axis, from the left to the right, the bit lines BL, the common voltage lines VSSL, the power voltage lines VDDCL and the bit bar lines ZBL are disposed in turn of the bit line BL, the power voltage line VCCL, the bit bar line ZBL, the bit bar line ZBL, the power voltage line VCCL, the bit line along the second axis direction of the LSB SRAM, wherein a common voltage line is disposed between each K cells because of the semiconductor manufacturing process. As shown in FIG. 2, the arrangement of the SRAM cell is symmetric along either X-axis direction or Y-axis direction. Moreover, in the present embodiment, the bit lines BL, the common voltage lines VSSL, the power voltage lines VDDCL and the bit bar lines ZBL along the direction of X-axis are disposed on the second metal layer M2.

Figure 4:
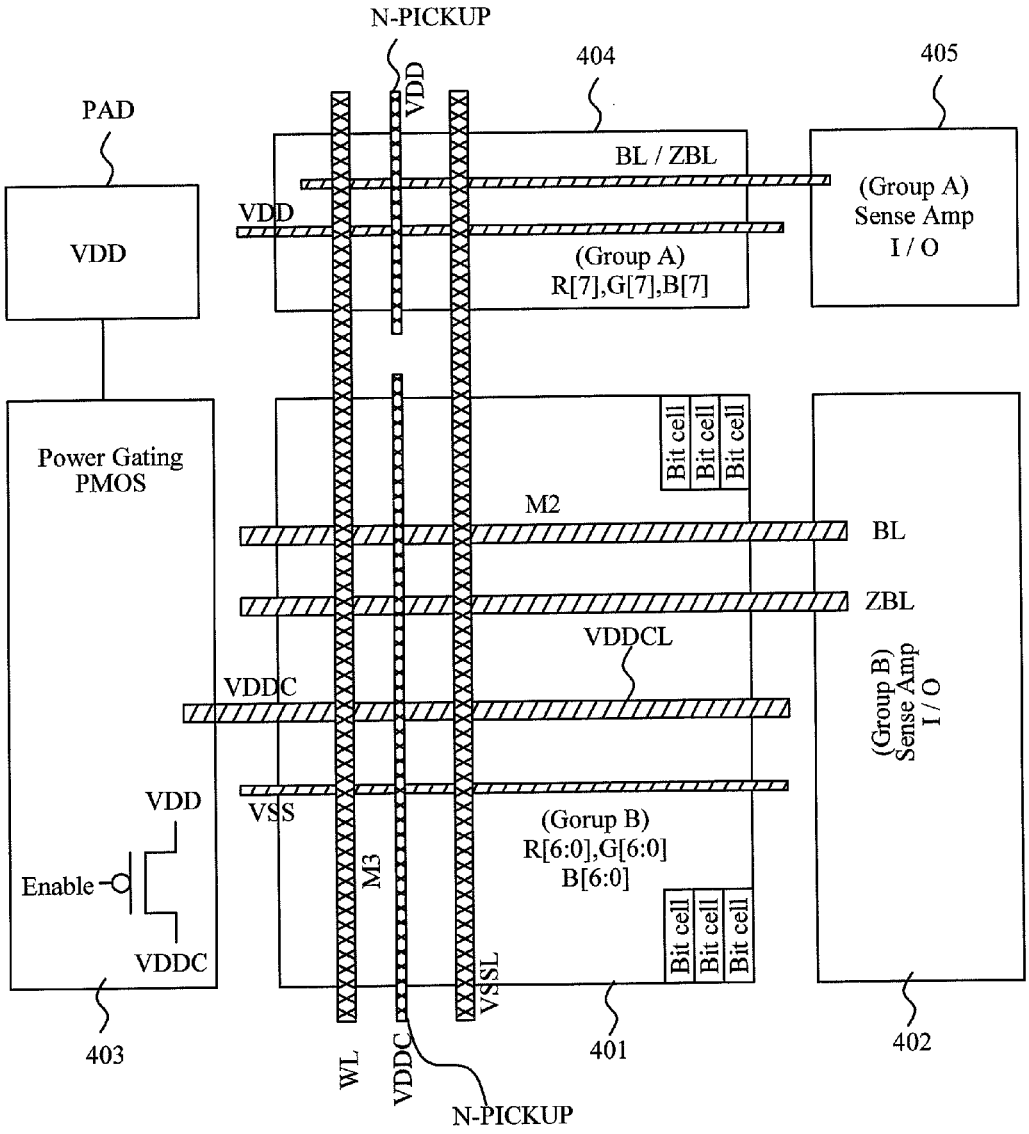
FIG. 4 is a circuit layout depicting a top view of the LSB SRAM array after the enlargement according to the first embodiment of the present invention.

FIG. 4 is a circuit layout depicting a top view of the LSB SRAM array after the enlargement according to the first embodiment of the present invention. Referring to FIG. 4, the layout of the SRAM array includes not only a LSB SRAM array 401, but also a LSB sensing amplifier 402, a P-type MOSFET 403, a MSB SRAM array 404 and a MSB sensing amplifier 405. General Speaking, a pixel of an LCD display has 24 bits, wherein each color (Red, Green and Blue) has 8 bits. The MSB generally is the one bit with the highest weight, and the LSBs generally are the residual 7 bits with lower weight. Therefore, in FIG. 4, the layout area of the MSB SRAM array 404 is smaller than the layout area of the LSB SRAM array 401. However, people having ordinary skill in the art should know that the bit length of LSB and the bit length of MSB can be adjusted in accordance with different designs. Therefore, when the design is changed, the bit length of MSB may not be one bit, and the bit length of LSB may not be 7 bits.

Referring to FIG. 4, the layout area of the P-type MOSFET 403 occupies a large area because the P-type MOSFET 403 is coupled between the power voltage lines VDDCL along the direction of the X-axis and the pad PAD. The LSB SRAM array 401 receives the supplied power through the P-type MOSFET 403. Thus, the design of the P-type MOSFET 403 should be able to withstand high current.

When the LCD display is in normal mode, the P-type MOSFET 403 is turned on such that the LCD driver can access the frame or the scan line from the SRAM. When the LCD enters the power saving mode, such as a wait state or an idle state, since the LCD has MIP, it is unnecessary to access the LSB SRAM array 401 in the SRAM, only the MSB SRAM array 404 and the MSB sensing amplifier 405 should be active, the LCD accesses the MSB SRAM array 404 one time per second. Meanwhile, the gate of the P-type MOSFET 403 receives an idle signal with a logic high voltage such that the P-type MOSFET 403 enters the cut-off state for disconnecting the power supplied to the LSB SRAM array 401. Since the power voltage VDD is isolated, the leakage current of the cells of SRAM is solved and the power consumption would be reduced.

Figure 5:
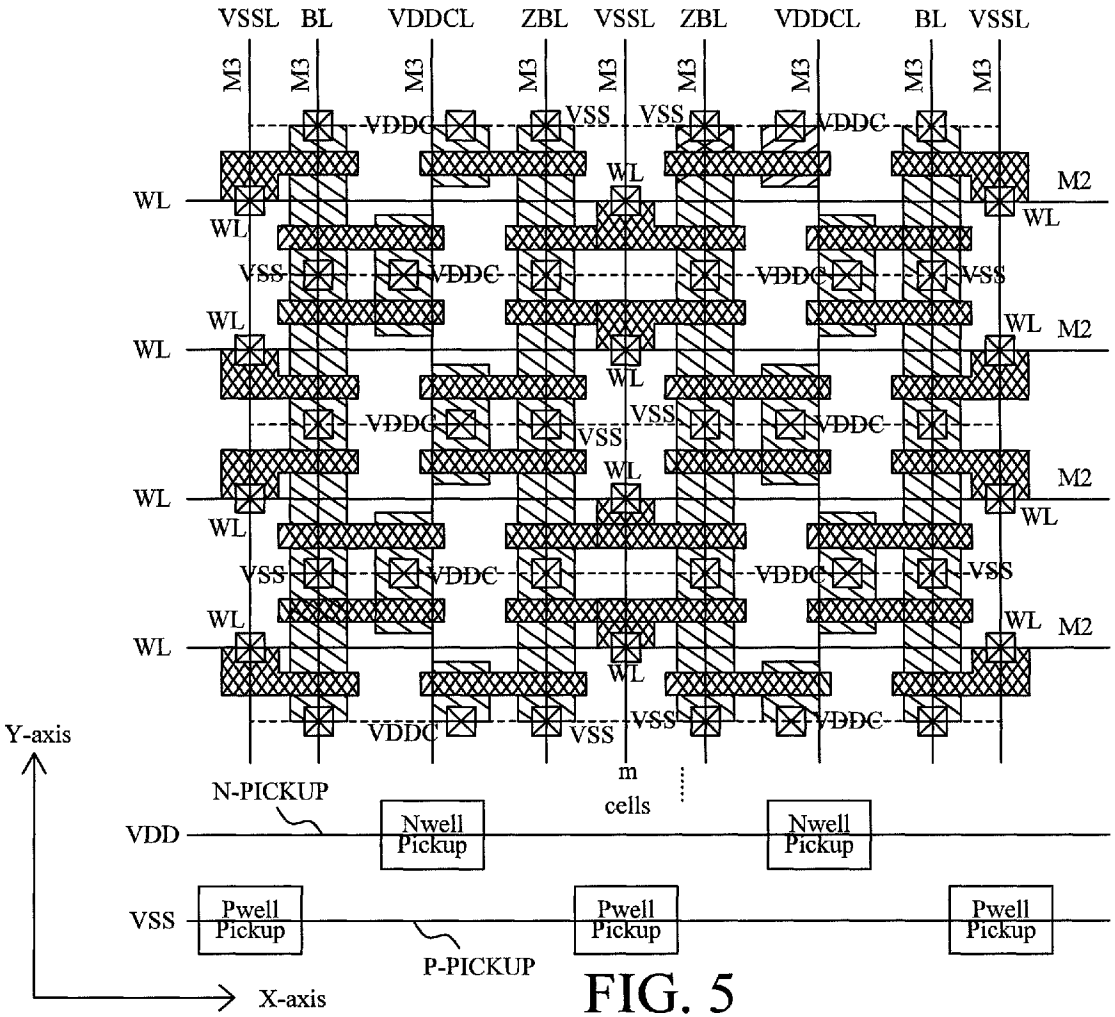
FIG. 5 is a circuit layout depicting a partial top view of the LSB SRAM array according to the second embodiment of the present invention.

FIG. 5 is a circuit layout depicting a partial top view of the LSB SRAM array according to the second embodiment of the present invention. Referring to FIG. 5, similarly, in the present embodiment, the SRAM array is divided into two partitions, an LSB SRAM array and a MSB SRAM array. The layout of the LSB SRAM array is illustrated in FIG. 5. Since the LCD display has MIP, when the LCD display enters the power saving mode, such as a wait state or an idle state, the frame only refreshes one time per second, also only MSB should be refreshed. Thus, in this embodiment, the layout of the LSB SRAM array and the layout of the MSB SRAM array are separated.

Along the direction of Y-axis, the metal lines includes the word lines WL, the N-well pick-up power connecting lines N-PICKUP, and the P-well pick-up power connecting lines P-PICKUP. In order to prevent the body effect, a N-well pick-up power connecting line and a P-well pick-up power connecting line P-PICKUP are disposed every N memory cells. The P-well pick-up power connecting lines P-PICKUP are electrically connected to the common voltage VSS. In particular, the N-well pick-up power connecting lines N-PICKUP are electrically connected to the power voltage VDD and N-well. In the present embodiment, the word lines WL, the N-well pick-up power connecting lines N-PICKUP, and the P-well pick-up power connecting lines P-PICKUP are disposed on the second metal layer M2.

Along the direction of X-axis, from the left to the right, the metal lines are disposed in turn of the common voltage line VSSL, the bit line BL, the power voltage line VDDCL, the bit bar line ZBL, the common voltage line VSSL, the bit bar line ZBL, the power voltage line VDDCL, the bit line BL, the common voltage line VSSL which are symmetrical. Referring to FIG. 5, the arrangement of the memory cell of the SRAM is symmetrical either in the direction of X-axis or in the direction of Y-axis, wherein the bit lines BL, the common voltage lines VSSL, the power voltage lines VDDCL and the bit bar lines ZBL are disposed on the third metal layer M3.

Figure 6:
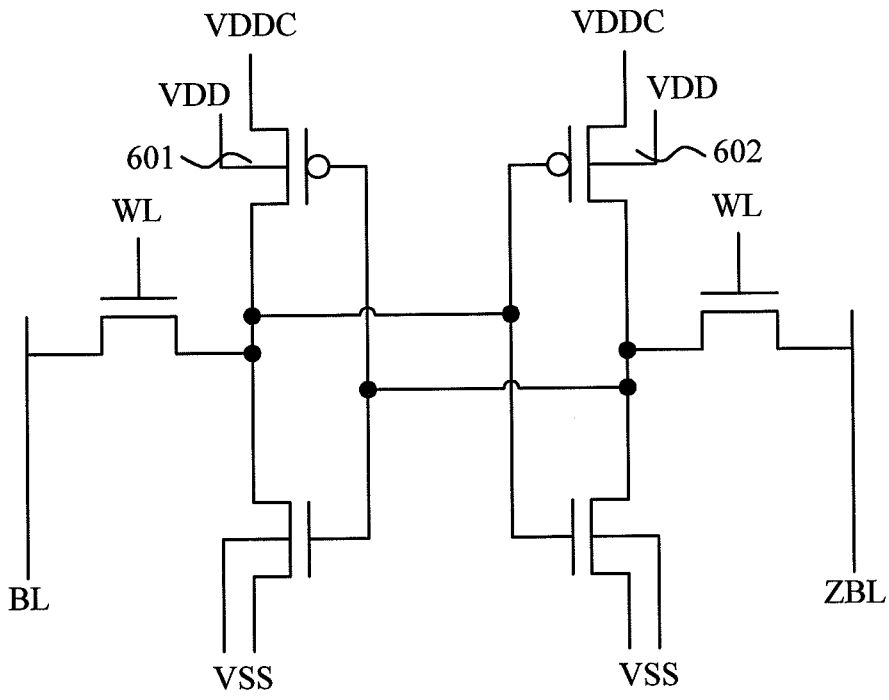
FIG. 6 is a circuit diagram depicting a cell of a SRAM according to the second embodiment of the present invention.

FIG. 6 is a circuit diagram depicting a cell of a SRAM according to the second embodiment of the present invention. Referring to FIG. 6, the SRAM cell includes six transistors. The body terminal of the P-type MOSFETs 601 and 602 is coupled to the power voltage VDD due to the semiconductor manufacturing process.

Figure 7:
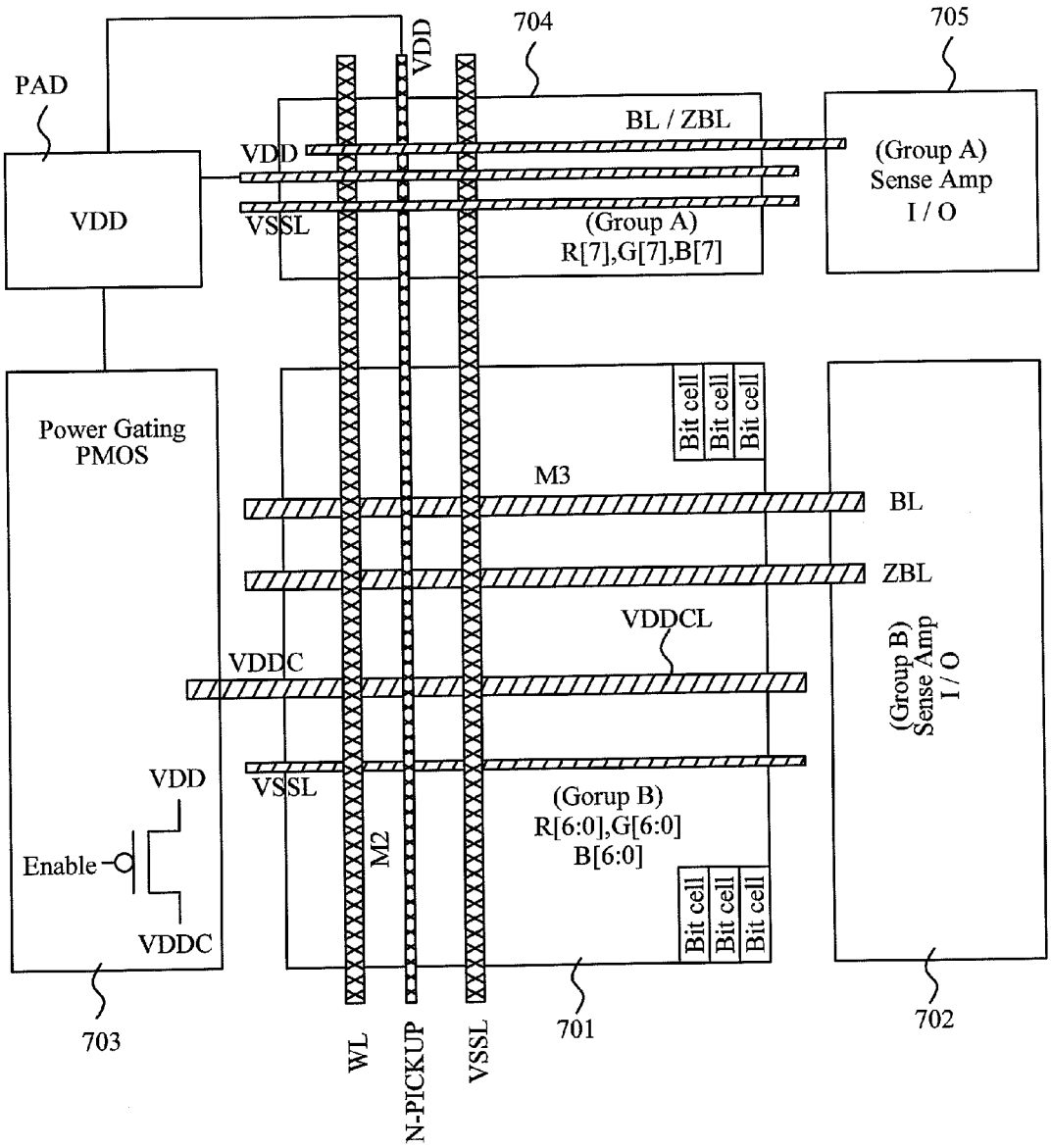
FIG. 7 is a circuit layout depicting a top view of the LSB SRAM array after the enlargement according to the second embodiment of the present invention.

FIG. 7 is a circuit layout depicting a top view of the LSB SRAM array after the enlargement according to the second embodiment of the present invention. Referring to FIG. 7, the layout of the SRAM array includes not only the LSB SRAM array 701 shown in FIG. 5, but a LSB sensing amplifier 702, a P-type MOSFET 703, a MSB SRAM array 704 and a MSB sensing amplifier 705.

Referring to FIG. 6, since the semiconductor manufacturing process in the present embodiment is different from that of the first embodiment, the N-well pick-up power connecting lines of the LSB SRAM array 701 and the MSB SRAM array 704 has to be electrically connected to the power voltage VDD.

Since the P-type MOSFET 703 is coupled between the pad PAD and the plurality of power voltage lines VDDCL along the direction of X-axis for isolating the power voltage VDD, the LSB SRAM array 701 receives the supplied power through the P-type MOSFET 703, the design of the P-type MOSFET 703 should be able to withstand high current. Thus, the large layout area of the P-type MOSFET 703 is necessary.

When the LCD display is in a normal mode, the P-type MOSFET 703 is turned on such that the LCD driver can access the frame or the scan line from the SRAM. When the LCD enters the power saving mode, such as a wait state or an idle state, since the LCD has MIP, it is unnecessary to access the LSB SRAM array 701 in the SRAM, only the MSB SRAM array 704 and the MSB sensing amplifier 705 should be active, the LCD accesses the MSB SRAM array 404 one time per second. Meanwhile, the gate of the P-type MOSFET 703 receives an idle signal with a logic high voltage such that the P-type MOSFET 703 enters the cut-off state for disconnecting the power supplied to the LSB SRAM array 701. Since the power voltage VDD is isolated, the leakage current of the cells of SRAM is solved and the power consumption would be reduced.

In summary, the present invention disposes an extra high-current endurable power transistor between the power supply metal layer of the LSB SRAM array and the pad. When the idle mode is entered, the power transistor electrically disconnects the circuit between the pad and the LSB SRAM array such that the leakage current is avoided and the power consumption thereof is thus reduced.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A driving circuit, adapted for a liquid crystal display, wherein the liquid crystal display has memory in pixel, the driving circuit comprising:

a least significant bit (LSB) static random access memory (SRAM) array, including a plurality of word lines and a plurality of bit lines respectively disposed along a first axis direction and a second axis direction, wherein along the first axis direction, the LSB SRAM array further comprises a plurality of first common voltage lines, electrically connected to a common voltage, interlacing and disposing with the word lines, wherein when the number of the word lines reach a first amount, a first N-well pick-up power connecting line and a P-well pick-up power connecting line are disposed, and the P-well pick-up power connecting line is electrically connected to the common voltage; and wherein along the second axis direction, the LSB SRAM array further comprises a plurality of bit bar lines and a plurality of first power voltage lines, wherein the bit lines, the first power voltage lines, and the bit bar lines are disposed in turn of the bit line, the first power voltage line, the bit bar line, the bit bar line, the first power voltage line, the bit line along the second axis direction of the LSB SRAM, and a second common voltage line is disposed when the number of the bit lines reach a second amount;

a pad, electrically connected to a power voltage;

a power transistor, comprising a gate terminal, a first source/drain terminal and a second source/drain terminal, wherein the first source/drain terminal is coupled to the pad, the gate terminal receives a standby signal, and the second source/drain terminal is coupled to the first N-well pick-up power connecting lines and the first power voltage lines; and a most significant bit (MSB) static random access memory (SRAM) array, comprising a plurality of second N-well pick-up power connecting lines and a plurality of second power voltage lines, wherein the second N-well pick-up power connecting lines and the second power voltage lines are respectively coupled to the power voltage, wherein the MSB SRAM array and the LSB SRAM share the word lines, the first common voltage lines and the P-well pick-up power connecting lines;

wherein when the standby signal enables, the power transistor is cut off the electrical connection between the first source/drain terminal and the second source/drain terminal.

2. The driving circuit according to claim 1, wherein the power transistor is P-type transistor.

3. The driving circuit according to claim 1, wherein the bit lines, the bit bar lines, the second common voltage lines and the power voltage lines are disposed on a second metal layer.

4. The driving circuit according to claim 3, wherein the word lines, the first common voltage lines, the first N-well pick-up power connecting lines, and the P-well pick-up power connecting lines are disposed on a third metal layer.

5. The driving circuit according to claim 1, wherein the LSB SRAM array and the MSB SRAM array are used for storing a plurality of pixel data, said pixel data comprises three sub-pixel data, and said sub-pixel data comprises a sequence of K bits comprising most significant bit (MSB) and least significant bits (LSBs), wherein the MSB comprises at least one bit of the K bits having the largest weight in the sequence of the K bits, and K is a nature number.

6. The driving circuit according to claim 5, wherein K is equal to 8, and the LSBs is 7 bits.

7. A driving circuit, adapted for a liquid crystal display, wherein the liquid crystal display has memory in pixel, the driving circuit comprising:

a least significant bit (LSB) static random access memory (SRAM) array, including a plurality of word lines and a plurality of bit lines respectively disposed along a first axis direction and a second axis direction, wherein a N-well pick-up power connecting line and a P-well pick-up power connecting line are disposed when the number of the word lines reach a first amount, the N-well pick-up power connecting line is electrically connected to a power voltage, and the P-well pick-up power connecting line is electrically connected to a common voltage, and the LSB SRAM array further includes a plurality of bit bar lines, a plurality of first power voltage lines and a plurality of common voltage lines are disposed along the second axis direction of the LSB SRAM array, wherein the common voltage lines are electrically connected to the common voltage; a pad, coupled to the power voltage;

a power transistor, comprising a gate terminal, a first source/drain terminal and a second source/drain terminal, the first source/drain terminal is coupled to the pad, the gate terminal receiving a standby signal, the second source/drain terminal is coupled to the first N-well pick-up power connecting lines and the first power voltage lines, wherein when the standby signal enables, the power transistor is cut off the electrical connection between the first source/drain terminal and the second source/drain terminal; and a most significant bit (MSB) static random access memory (SRAM) array, comprising a plurality of second N-well pick-up power connecting lines, and the second N-well pick-up power connecting lines are coupled to the power voltage, wherein the MSB SRAM array and the LSB SRAM array share the word lines, the N-well pick-up power connecting lines and the P-well pick-up power connecting lines;

wherein the bit lines, the first power voltage lines, the common voltage lines and the bit bar lines are disposed in turn of the bit line, the first power voltage line, the bit bar line, the common voltage line, the bit bar line, the first power voltage line, the bit line and the common voltage line.

8. The driving circuit according to claim 7, wherein the power transistor is P-type transistor.

9. The driving circuit according to claim 7, wherein the N-well pick-up power connecting lines and the P-well pick-up power connecting lines are disposed on a second metal layer.

10. The driving circuit according to claim 7, wherein the bit lines, the bit bar lines, the first power voltage lines and the common voltage lines are disposed on a third metal layer.

11. The driving circuit according to claim 7, wherein the LSB SRAM array and the MSB SRAM array are used for storing a plurality of pixel data, said pixel data comprises three sub-pixel data, and said sub-pixel data comprises a sequence of K bits comprising most significant bit (MSB) and least significant bits (LSBs), wherein the MSB comprises at least one bit of the K bits having the largest weight in the sequence of the K bits, and K is a nature number.

12. The driving circuit according to claim 11, wherein K is equal to 8, and the LSBs is 7 bits.

* * * * *